US005808252A

United States Patent [19]

Makuc et al.

[11] Patent Number: 5,808,252

[45] Date of Patent: Sep. 15, 1998

[54] PADLOCKABLE EMERGENCY STOP BUTTON

[75] Inventors: Daniel Makuc, Longvic; Jacques Marcenne, Dijon, both of France

[73] Assignee: Schneider Electric SA, Boulogne Billancourt, France

[21] Appl. No.: 813,035

[22] Filed: Mar. 6, 1997

[30] Foreign Application Priority Data

Apr. 5, 1996 [FR] France ..... 96 04431

[51] Int. Cl.[6] ..... H01H 9/20

[52] U.S. Cl. ..... 200/50.01; 200/43.11

[58] Field of Search ..... 200/50.01, 50.02, 200/50.03–50.4, 43.01–43.22, 321, 322, 327

[56] References Cited

U.S. PATENT DOCUMENTS 3,624,321 11/1971 Puetz et al. ..... 200/43.13
4,005,459 1/1977 Kobayashi ..... 396/472
5,477,016 12/1995 Baginski et al. ..... 200/43.11
5,504,284 4/1996 Lazareth et al. ..... 200/50.01
5,610,375 3/1997 Sinthomez ..... 200/50.01

FOREIGN PATENT DOCUMENTS 87 04 026 6/1987 Germany .
89 07 888 9/1989 Germany .

*Primary Examiner*—J. R. Scott
*Attorney, Agent, or Firm*—Oblon, Spivak, McClelland, Maier & Neustadt, P.C.

[57] ABSTRACT

An emergency stop button actuated by pushing and unlocked by rotation. A lug 16 provided on the skirt 12 of the head 11 of the button works with a sliding plate 20 which can block the head when it is pulled and put into the interlocked position. The sliding plate has, for this purpose, an abutment face 25 for the lug and a window 24 to allow the lug to pass when it is rotated in order to unlock the emergency stop button.

7 Claims, 2 Drawing Sheets

PADLOCKABLE EMERGENCY STOP BUTTON

BACKGROUND OF THE INVENTION

Field of the Invention

This invention relates to a padlockable emergency stop button set on a mounting wall and including an actuation head, which is capable of acting upon electrical contacts, on the one hand by moving in translation along a determined axis from a go position to an interlocked stop position and, on the other hand, of turning about this axis in order to be unlocked so as to return to the go position.

There are already numerous devices that allow levers and buttons for actuating electrical apparatus to be padlocked into a position which restricts them to remaining in the stop position (see for example document EP-202 991). These devices operate either by clamping an actuating button that controls both the stopping and the starting of an apparatus in the stop position or by clamping a button that only controls the starting of the apparatus in the inactive position. The application of known devices to an emergency stop button is not easy however since the head of the button is recessed in its stop position.

The invention aims to permit very simply and in a manner that takes up little space, the padlocking of an emergency stop button of the type described, that can be unlocked by rotation.

SUMMARY OF THE INVENTION

According to the invention, a lug is made integral with the actuation head, preferably with a tubular skirt of it, projecting radially towards the outside and a sliding plate is provided for blocking the actuation head, this sliding plate being able to be pulled and displaced in translation in a direction perpendicular to the axis of the emergency stop button, from a blocking position to an unblocking position and having an element for stopping the rotation of the lug and at least one orifice for a padlock to pass through. Furthermore, the sliding plate can be advantageously fitted with an overhang provided to work with the lug via an abutment so that, in the go position it prevents the sliding plate coming out, and/or in the stop position it prevents the actuation head coming back up in an untimely way.

Preferably, the element stopping rotation of the lug is an abutment face provided on a longitudinal bar of the sliding plate in order to block the rotation of the lug close to a window made in the bar to allow the lug to pass through it in rotation. Furthermore, it is advantageous that the padlocking orifice be concealed in the unblocking position by the guide surfaces for the sliding plate.

BRIEF DESCRIPTION OF THE DRAWINGS

The description that will be made of an embodiment of the invention, with reference to appended drawings, clarifies the advantages and effects of it.

DESCRIPTION OF THE PREFERRED EMBODIMENTS

Figure 1:
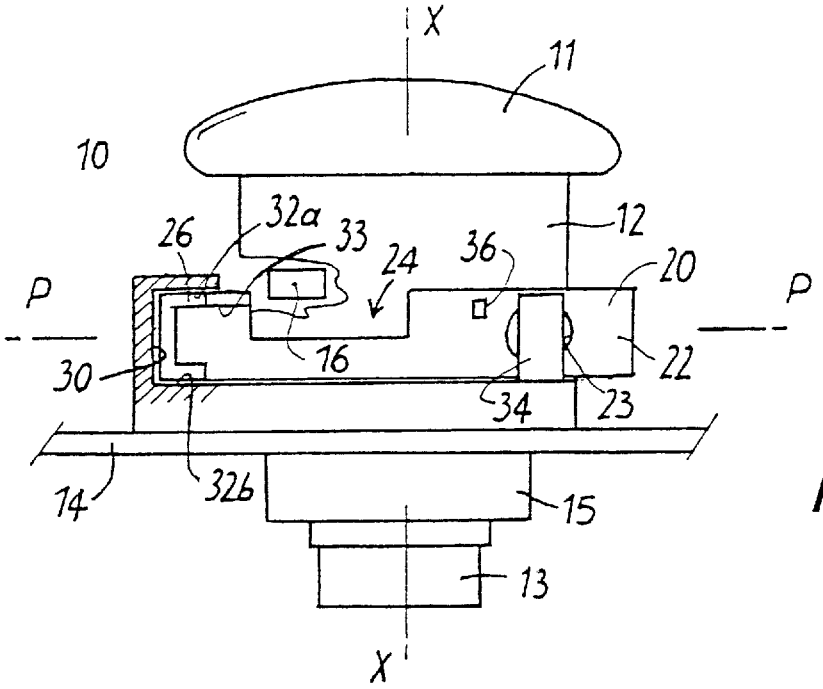
FIG. 1 shows an elevation of an emergency stop button in the go position.

The emergency stop button 10 illustrated in the Figures includes an actuation head 11 fitted with a tubular skirt 12 and a push button actuated by this head to act upon an electrical apparatus which is not shown and which is housed behind a hood, a partition or another mounting wall such as the wall of a casing 14. The emergency stop button 10 is, for example, fixed to the wall 14 by means of a nut 15.

It is the type which is punched and which is unlocked by rotation, that is to say it can pass from a "go" position in which the head is out (FIG. 1) to a "stop" position in which the head is in (FIG. 2), passage between these position having taken place under the effect of a push exerted manually by the operator along an axis X. The emergency stop button remains held in the stop position by interlocking means not shown until the operator exerts a rotating movement in a clockwise direction about the axis X, the head then returning to its "go" position.

The tubular skirt of the emergency stop button has a lug 16 projecting radially towards the outside provided to work with a blocking sliding plate 20. The sliding plate can be pulled and displaced in translation along a direction Y normal to X and can take up an unblocking position (see FIGS. 1 and 3) and a blocking position (see FIGS. 2 and 4) for the emergency stop button.

Figure 3:
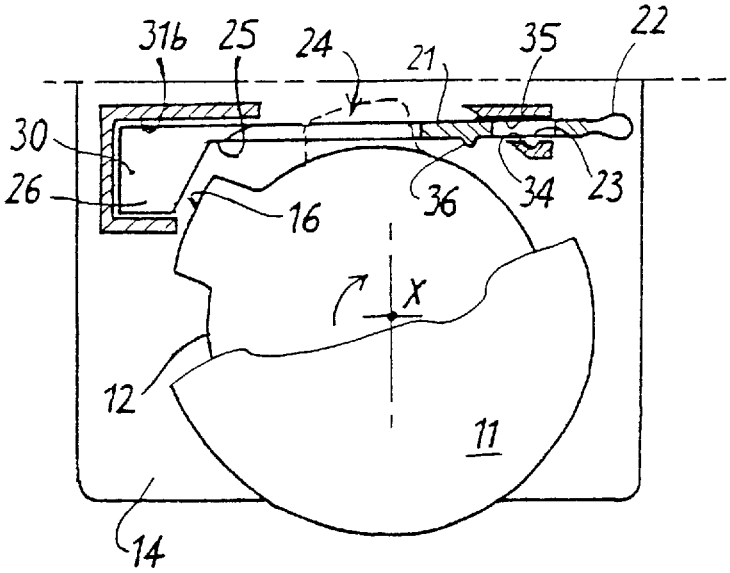
FIGS. 3 and 4 show, in section along plane P of FIGS. 1 and 2, the emergency stop button in the corresponding positions.

As may be better seen in FIG. 3, the sliding plate 20 is arranged on the side of the emergency stop button where the lug is and includes a longitudinal bar 21 equipped, close to a gripping end 22, with a padlocking orifice 23, which can receive at least one padlock; of course, several orifices (23) could be provided. On the other hand, the bar 21 has a window 24 made in it through which the lug 16 can pass and, close to this window an abutment face 25 for the lug. In place of this window one can of course provide any other space for free passage of the lug. When one wishes to turn the head 11 in a clockwise direction, as far as its unlocking position, the window 24 allows, with the sliding plate in the unblocking position, passage of the lug 16 through it (as shown in FIG. 3 in dashed lines), while with the sliding plate in the blocking position, the abutment face 25 prevents the lug 16 from passing (as shown in dashed lines in FIG. 4).

At the end 26 opposite to the gripping end 22, the sliding plate 20 has guide faces 27*a*, 27*b* and 28*a*, 28*b* which work with the corresponding guide walls 31*a*, 31*b* and 32*a*, 32*b* provided in a housing 30; this housing is integral with the mounting wall 14 and is, for example moulded with it. The housing 30 then has a shoulder or an overhang 33 which extends parallel to plane P and perpendicular to direction X; the overhang, when the head 11 is out, prevents the sliding plate from coming out, thanks to its abutment against the lug 16 and when the head 11 is in, in the stop position, and the sliding plate has been put into a blocking position, the overhang prevents the lug from moving upwards, thereby contributing to the safety of the device.

Close to the gripping end 22, the mounting wall 14 includes in addition guide walls 34,35 which are used to guide the sliding plate and to conceal the padlocking orifice 23 of the sliding plate when it is in its blocking position.

It will be observed that the bar 21 has a ratchet element 36 such as a pin, a lug, a hard point or resilient tab to work with a complementary ratchet element 37 provided in an adjacent wall, for example, in the guide wall 34 or 35 so as to hold the sliding plate in a blocking position. Holding the sliding plate in an unblocking position is provided by friction of the various guide surfaces and possibly by the presence of a hard point. A resilient return element can be associated with the sliding plate.

The described emergency stop button operates in the following way.

Figure 2:
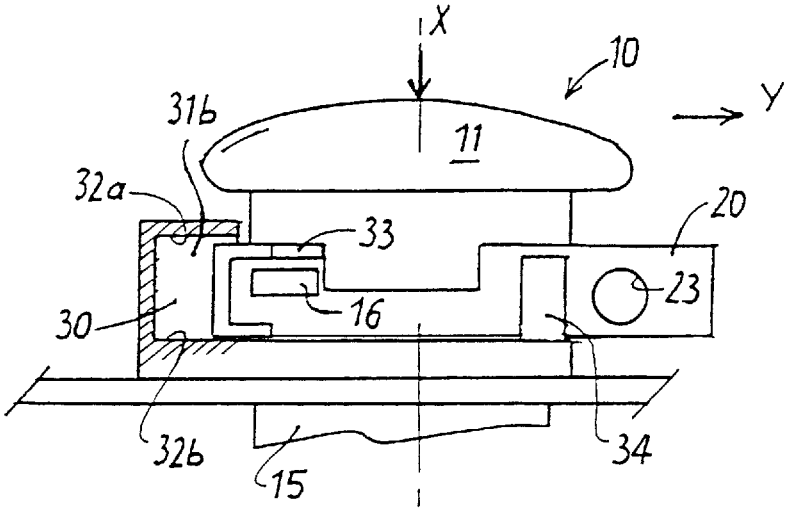
FIG. 2 shows the emergency stop button in the stop position, interlocked and blocked.

If initially the electrical apparatus is running, the head of the emergency stop button is out (FIG. 1). It should be noted that in this operating condition the sliding plate cannot be brought from its position in FIG. 1 to that in FIG. 2 since its overhang 33 abuts against one side of the lug 16. If the operator wants to stop the apparatus, he presses the head 11 (FIG. 2), the lug 16 staying in the nominal angular position shown in full lines in FIGS. 1 and 3. The head then stays interlocked in this position by its interlocking means which are not shown.

If he does not wish to block the button, the operator leaves the sliding plate in the position shown in FIGS. 1 and 3; he can unlock the head by turning it in a clockwise direction since the lug, being able to pass freely through the window 24 is then brought to the position shown in dashed lines in FIG. 3. The head is again pushed upwards and returns to its initial angular position under the effect of its own resilient means and the emergency stop button thereby returns to the go position.

Figure 4:
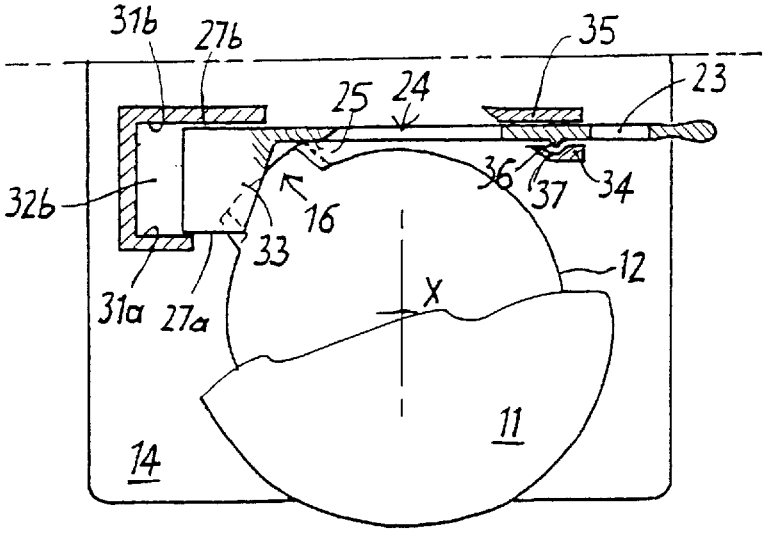
Figure 5:
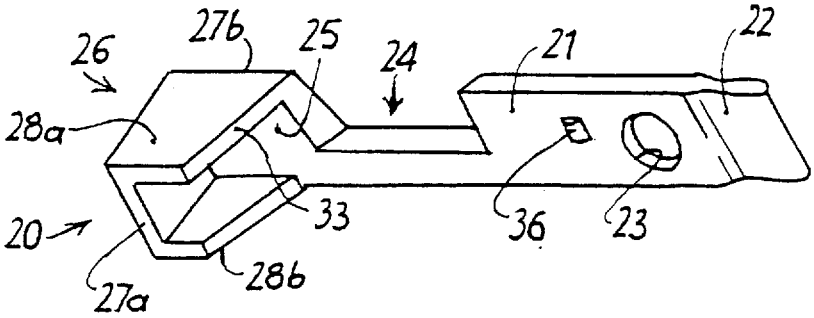
FIG. 5 shows, in perspective, the blocking sliding plate associated with the emergency stop button.

If he wishes to block the button, the operator pulls the sliding plate to cause it to pass from the position in FIG. 3 to that in FIG. 4. He can then introduce a padlock through the orifice 23 then made available, which blocks the head in the stop position: in effect, any attempt to turn the head in a clockwise direction is bound to be unsuccessful since the lug 16 abuts against face 25 of the sliding plate (in dashed lines in FIG. 4). The sliding plate is held in the blocking position by the ratchet elements 36,37. In order to unblock the button, it is advisable to remove the padlock, push the sliding plate to the position in FIG. 3 and to turn the head in a clockwise direction as previously indicated.

What is claimed as new and desired to be secured by Letters Patent of the United States:

1. A padlockable emergency stop button set on a mounting wall and including an actuation head, which is capable of moving in translation along a determined axis from a go position, corresponding to closed electrical contacts, to an interlocked stop position and capable of turning about this axis in order to be unlocked so as to return to the go position, comprising:

a radially projecting lug provided on the actuation head; and a sliding plate which, when pulled, blocks the actuation head, wherein said sliding plate is movable in translation along a direction perpendicular to the axis of the emergency stop button, from a blocking position to an unblocking position and from an unblocking position to a blocking position;

wherein the sliding plate when pulled, has an element for stopping rotation of the lug and an orifice for receiving a padlock in order to lock the sliding plate.

2. An emergency stop button according to claim 1, wherein the element for stopping rotation of the lug is an abutment face provided on a longitudinal bar of the pulled sliding plate to block the rotation of the lug, said longitudinal bar including to a window to allow the lug to pass in rotation.

3. An emergency stop button according to claim 1, wherein the orifice is concealed in the unblocking position of the sliding plate by at least one guide surface for the sliding plate, wherein said at least one guide surface is integral with the mounting wall.

4. An emergency stop button according to claim 1, wherein the sliding plate has an overhand which extends perpendicular to the axis of the head to prevent the lug rising again when the head is the stop position and the sliding plate is in the blocking position.

5. An emergency stop button according to claim 1, wherein the sliding plate has an overhang arranged in such a way that, when the actuation head is in the go position, it is thrust against the lug when a pulling force is exerted on the sliding plate.

6. An emergency stop button according to claim 1, wherein the mounting wall is integral with a housing of the end of the sliding plate, and wherein the housing includes an overhang intended to work with the lug and on lateral faces for guiding the sliding plate.

7. An emergency stop button according to claim 1, wherein the sliding plate includes a ratchet element that works with a corresponding element provided on a guide wall which is part of the mounting wall in order to hold the pulled sliding plate in the blocking position.

* * * * *